US006244694B1

(12) United States Patent
Weber et al.

(10) Patent No.: US 6,244,694 B1
(45) Date of Patent: Jun. 12, 2001

(54) METHOD AND APPARATUS FOR DAMPENING VIBRATION IN THE INK IN COMPUTER CONTROLLED PRINTERS

(75) Inventors: Timothy L Weber, Corvallis, OR (US); Edward Maker, II, Menlo Park, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/368,320

(22) Filed: Aug. 3, 1999

(51) Int. Cl.[7] ..... B41J 2/05; B41J 2/17

(52) U.S. Cl. ..... 347/65; 347/94

(58) Field of Search ..... 347/63, 65, 89, 347/94, 84–87, 17, 18

(56) References Cited

U.S. PATENT DOCUMENTS 4,496,960 * 1/1985 Fischbeck ..... 347/94
4,612,553 * 9/1986 Kohler ..... 347/89
5,455,613 10/1995 Canfield et al. ..... 347/65
5,459,498 * 10/1995 Seccombe et al. ..... 347/18
5,755,032 5/1998 Pan et al. ..... 347/65
5,815,173 * 9/1998 Silverbrook ..... 347/15
5,818,485 * 10/1998 Rezanka ..... 347/89

* cited by examiner

*Primary Examiner*—John Barlow
*Assistant Examiner*—Juanita Stephens
(74) *Attorney, Agent, or Firm*—Edward Maker, II

(57) ABSTRACT

In a computer controlled, drop-by-drop, inkjet printer, either thermal ink-jet or piezoelectric, an apparatus for dampening the vibration caused by expelling the drops of ink. The apparatus includes an inlet and an outlet flow conduit connected to the chamber from which the drops are expelled and means for sweeping the vibration out of the chamber and into one of the flow conduits. In operation, the apparatus first expels a drop of liquid from the chamber and thereby creates a region of vibration in the liquid remaining in the chamber. The flow of liquid through the chamber flushes the region of vibration out of the chamber and into the outlet flow conduit, thereby hydraulically dampening the vibration.

23 Claims, 4 Drawing Sheets

METHOD AND APPARATUS FOR DAMPENING VIBRATION IN THE INK IN COMPUTER CONTROLLED PRINTERS

FIELD OF INVENTION

The present invention generally relates to computer controlled printers that expel ink drop-by-drop to form images and, more particularly, to methods and apparatus for improving the operation of such printers.

BACKGROUND OF THE INVENTION

Computer controlled printers and in particular ink-jet and piezoelectric printers have been commercially available since at least the late 1980's. Their general construction is also well known, being the subject of numerous patents world-wide. An example of this technology can be found in U.S. Pat. No. 5,455,613 entitled "Thin Film Resistor Printhead Architecture for Thermal Ink-Jet Pens" by Canfield et al. issued on Oct. 3, 1995.

In a computer controlled printer, the ink is expelled drop-by-drop in a controlled manner. In a thermal ink-jet printer a firing resistor is electrically pulsed which in turn generates a drive bubble. The drive bubble expands in the firing chamber and expels a drop of ink from the chamber. In a piezoelectric printer a piezoelectric transducer is electrically pulsed which in turn expels a drop of ink from the chamber. In both, a region of vibration in the ink in the chamber is formed by the process of expelling the drop of ink. In addition, in both, the ink in the chamber bulges out of the orifice and a generally convex meniscus across the orifice results. The meniscus is not uniformly curved; the meniscus is actually oblate and also sloshes back and forth under the influence of the vibration of the ink in the chamber. The meniscus responds to a surface tension phenomenon. The ink in the chamber and the meniscus act much like a classical mass-spring-dashpot system.

Referring to FIG. 1, reference numeral 12 generally indicates a drop 14 of ink being expelled from an orifice plate 16 on the wall of a chamber 17. Reference numeral 18 indicates the generally convex meniscus resulting after the expulsion of the drop.

Before expelling the next drop of ink, the chamber should be refilled. Refilling the chamber with ink as fast as possible is a very desirable design goal. However, if ink flows into the chamber too fast, the ink will flow out of the orifice and leak into the printer. On the other hand, refilling too slowly will cause the printer to operate unnecessarily slowly and the media throughput of the printer will be adversely affected.

In addition, before expelling the next drop from the chamber, both the vibration in the chamber must be damped out as much as possible and the meniscus flattened, or the trajectory of the next drop will be adversely affected. Specifically, if the next drop is prematurely expelled, the drop will not travel along its designed path and the quality of the resulting image will be degraded.

The effects of less than optimum damping and refilling are best shown in the graph, FIG. 2, which illustrates how the weight of the drops expelled from an ink-jet print head vary as the frequency of a firing resistor is changed. The geometry of the chamber and the chemical properties of the ink remain unchanged in FIGS. 2 and 3. The optimum firing frequency for the resistor is indicated by reference numeral 20. The chamber overshoots and is not being damped sufficiently in the area indicated by reference numeral 21.

Heretofore, to properly damp the vibration in the chamber and to achieve optimum refilling times, five hydraulic resistance variables have been optimized either through computer modeling or trial and error or both. The two parameters for ink are viscosity and surface tension, and the three geometric parameters of the print head are the length, width, and height of the ink inlet channel to the chamber.

FIG. 3 illustrates a fully damped, prior art chamber in which the problem of being under damped, i.e., overshooting, was eliminated. Reference numeral 22 indicates the optimum firing frequency for this chamber. Typically to achieve this prior damping solution, the length of the inlet channel to the chamber was lengthened and the width and the height of the channel were decreased. However, although overshooting was eliminated, the optimum firing frequency 22 was reduced as compared to the optimum firing frequency 20 in FIG. 2. The net effect was that the printer ran slower and the output of media per minute was reduced.

It will be apparent from the foregoing that although there are well known ways of dampening the vibration in the ink in printers, there is still a need for an approach that allows the printer to operate as fast as possible while tolerating the maximum hydraulic under-damping that achieves acceptable print quality.

SUMMARY OF THE INVENTION

Briefly and in general terms, an apparatus according to the invention includes a means for expelling a liquid from a chamber drop-by-drop in a controlled manner, two flow conduits connected to the chamber, and means for sweeping the vibration, produced by the expulsion of a drop, out of the chamber and into one of the flow conduits.

In operation according to the invention, the apparatus expels a drop of liquid from the chamber and thereby creates a region of vibration in the liquid remaining in the chamber. The flow of liquid through the chamber sweeps the region of vibration out of the chamber, thereby hydraulically dampening the vibration.

The principal advantage of the invention is that by dampening the vibration in the chamber in the manner described, a printer can be operated at higher speeds and thus have a greater throughput of printed media, i.e., produce more printed pages per minute.

Further, the traditional mass-dashpot-spring damping system for the chamber is replaced by a new form of hydraulic compliance. Now instead of a "ringing" in the chamber that must be damped out and a convex meniscus forming at the orifice of the chamber that must be controlled, the flowing liquid entrains the vibration and its flow flushes the region of vibration out of the chamber via a second flow conduit.

The smaller hydraulic resistance of the chamber compared to the larger hydraulic resistances of the two flow conduits form a venturi that lowers the pressure in the chamber compared to the pressures in the two flow conduits. This lower pressure in the chamber decreases the curvature of the meniscus and lessens the likelihood of liquid flowing out of the orifice plate and into the printer.

The flow of liquid through the chamber results in several other benefits. The overall reliability of the firing resistor in a thermal inkjet print cartridge improves because after firing, the drive bubble is swept away from the resistor before collapsing and cavitation damage to the resistor is reduced. The flow also sweeps any entrapped air bubbles out of the chamber and out of the liquid flow path and onto other regions more suited to warehouse them without affecting the operation of the print head, thereby removing another source of drop trajectory instability. Also, the flow of ink through the print head carries off the heat generated in the print head by expelling drops.

Other aspects and advantages of the invention will become apparent from the following detailed description, taken in conjunction with the accompanying drawings, illustrating by way of example the principles of the invention.

DESCRIPTION OF THE PREFERRED EMBODIMENTS

Figure 1:
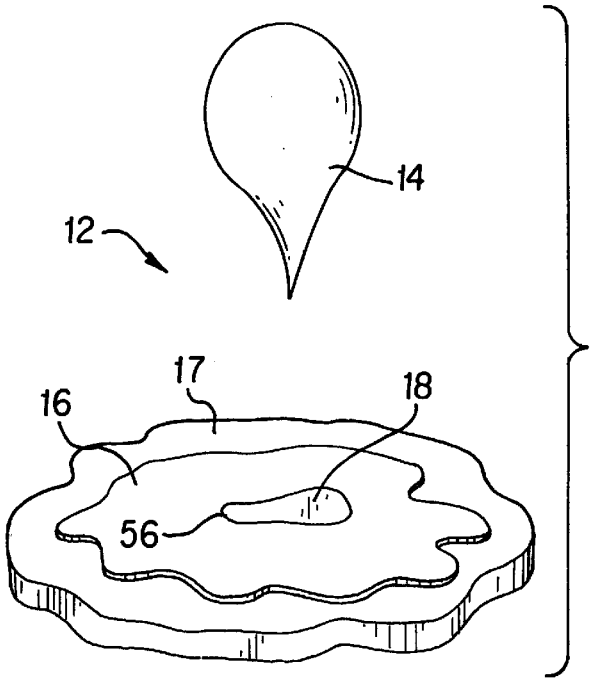
FIG. 1 is a diagrammic perspective view of a drop of ink being expelled from a printer.
Figure 2:
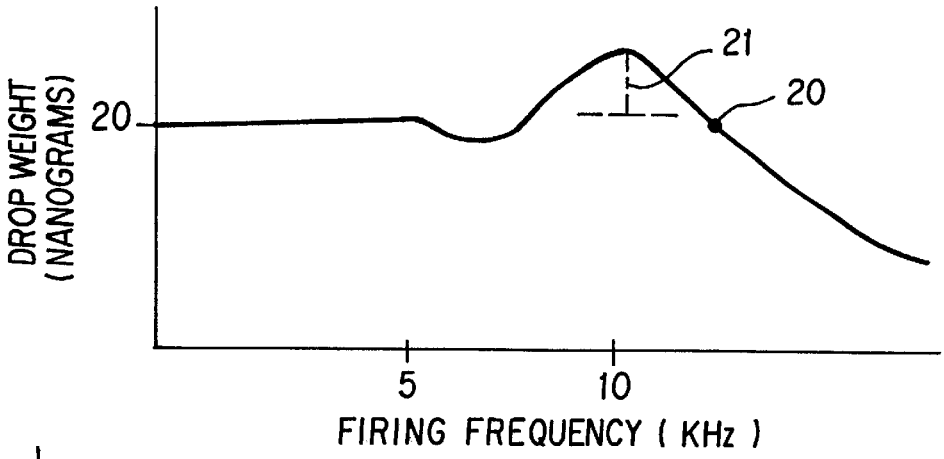
FIG. 2 is a graph of the weight of drops expelled from a undamped thermal ink-jet printer as the frequency of firing varies.
Figure 3:
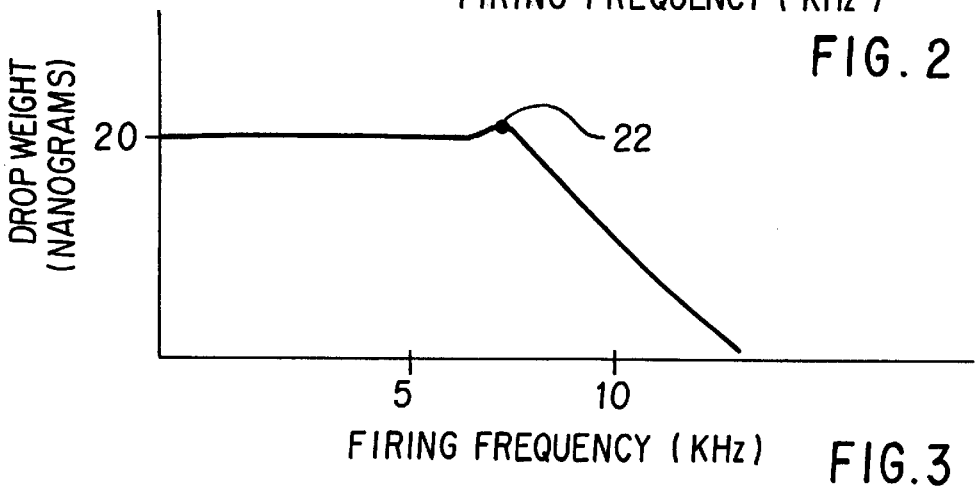
FIG. 3 is a graph of the weight of drops expelled from a vibration damped thermal ink-jet printer as the frequency of firing varies.

As shown in the drawings for the purposes of illustration, the invention is embodied in a computer controlled printer that expels liquid ink drop-by-drop from a chamber. The printer described below as the preferred embodiment is a thermal ink-jet printer, but a piezoelectric printer is contemplated to be within the scope of the invention as well.

Figure 4:
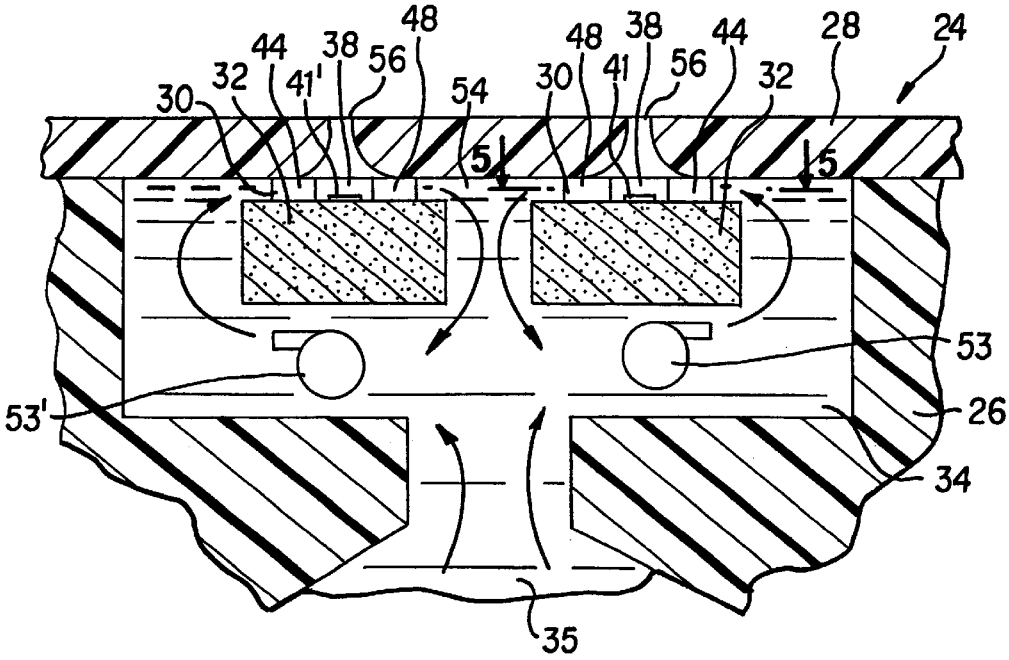
FIG. 4 is a side elevational view, in section and partially cut away, of a thermal ink-jet print head according to one embodiment of the present invention.
Figure 5:
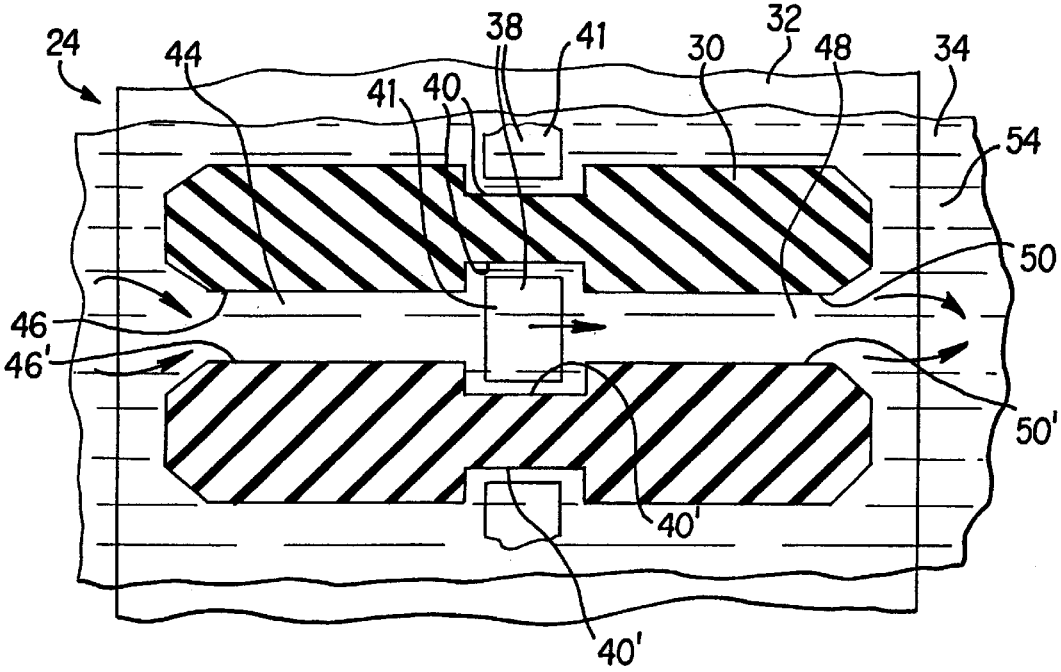
FIG. 5 is a top plan view, in section and partially cut away, of the thermal ink-jet print head of FIG. 4 taken along line 5—5 thereof.

Referring to FIGS. 4 and 5, reference numeral 24 generally indicates a thermal ink-jet print head. The print head is mounded on a print cartridge body 26 that is made of injection molded plastic and is of conventional construction. Rigidly attached to the cartridge body 26 is an orifice plate 28 from which ink is expelled drop-by-drop through an orifice 56 in a controlled manner by the printer. A silicon substrate 32, FIG. 4, and a barrier layer 30 are rigidly affixed to the orifice plate 28. The orifice plate 28 and the print cartridge body 26 form a containment for ink 34 that flows into the print head 24 from an ink reservoir 35.

Referring to FIG. 5, reference numeral 38 generally indicates a chamber 38 from which the drops of ink are expelled by the printer. The chamber is formed by the top surface, as illustrated in FIGS. 4 and 5, of the silicon substrate 32, the side walls 40 of the barrier layer 30, and the bottom surface of the orifice plate 28, including the orifice 56. The chamber has a hydraulic resistance to the flow of ink of R3. Located on the silicon substrate 32 and below the orifice 56 is a firing resistor 41. When the firing resistor is electrically pulsed by the printer, a drive bubble (not shown) is formed in the chamber and the bubble expands, expelling the drop of ink from the print head. FIG. 1 generally illustrates the process in which a drop of ink 14 is expelled from an orifice plate 16. The general construction and operation of a thermal ink-jet print head firing chamber is disclosed in detail in U.S. Pat. No. 5,455,613 cited above.

Referring to FIG. 5, hydraulically connected to the chamber 38 is an inlet flow conduit 44 or inlet channel for the ink 34. The inlet channel is formed by the top surface, as illustrated in FIGS. 4 and 5, of the silicon substrate 32, the inlet side walls 46 of the barrier layer 30, and the bottom surface of the orifice plate 28. The inlet channel has a hydraulic resistance to the flow of ink of R1. Likewise, hydraulically connected to the chamber 38 is an outlet flow conduit 48 or outlet channel for the ink 34. The outlet channel is formed by the top surface, as illustrated in FIGS. 4 and 5, of the silicon substrate 32, the outlet side walls 50 of the barrier layer 30, and the bottom surface of the orifice plate 28. The outlet channel has a hydraulic resistance to the flow of ink of R2. Both R1 and R2 are larger than R3, the hydraulic resistance of the chamber 38.

Referring to FIG. 4, reference numerals 53, 53' indicate two pumps for inducing the flow of ink through the inlet and outlet flow conduits 44, 48 and through the chamber 38. Although FIG. 4 illustrates a centrifugal pump, any pump for inducing the flow of ink through the chamber 38 is contemplated including a peristaltic pump, a vane pump, a fan type pump and a positive displacement pump. In FIG. 4 the pumps 53, 53' are opposed so that the flow of ink from each is initially directed outwardly within the print head 24. As illustrated, the flow of pump 53 around the silicon substrate 32 is counter-clockwise, and the flow of pump 53' is clockwise.

In operation, the two pumps 53, 53', FIG. 4 run at steady state and the ink 34 continuously recirculates in the print head 24. The ink flows upward, counter-clockwise from pump 53 and clockwise from pump 53'. Referring to FIG. 5, the ink 34 flows into the inlet channel 44, through the chamber 38, across the firing resistor 41, thereafter into the outlet channel 48, and down the feed slot 54 located between the two portions of the substrate 32. The flow of ink through each chamber 38 and across each firing resistor 41 in FIGS. 4 and 5 is continuous and at steady state.

A hydraulic venturi is formed in the print head 24 because the hydraulic resistances R1 and R2 to the flow of ink in the inlet and outlet chambers 44, 48 are larger than the hydraulic resistance R3 of the chamber 38.

When the firing resistor 41, FIGS. 4 and 5, is electrically pulsed by the printer, the resistor heats and generates a drive bubble that forces the drop of ink 14, FIG. 1 out of the orifice 56 of the orifice plate 16. The drive bubble thereafter collapses in the chamber 38. This process of generating a drive bubble and having it subsequently collapse generates an area of vibration in the ink in the chamber. This area of vibration is swept across the resistor 41, out of the chamber 38, and into the outlet flow channel 48 by the flow of ink described above. In effect, the area of vibration is entrained by the ink and flushed out of the chamber by the flowing ink. The process of generating a drive bubble and expelling a drop of ink occurs quickly compared to the rate of flow of the ink across the firing resistor so that the trajectory of the drop is not affected by the flow of ink.

The net effect of the flow of ink through the chamber 38 is that the chamber does not "ring" as much, the vibration of the meniscus is reduced, the ink is hydraulically damped optimumly, and the drive bubble does not collapse on the firing resistor 41. Most importantly, the flow of ink through the chamber 38 shortens the time spent for ink to refill the chamber and shortens the time between drop ejection.

As the drops 14, FIG. 1 of ink are expelled from the orifice 56, the ink in the print head 24 is replenished from the ink reservoir 35, FIG. 4.

Figure 6:
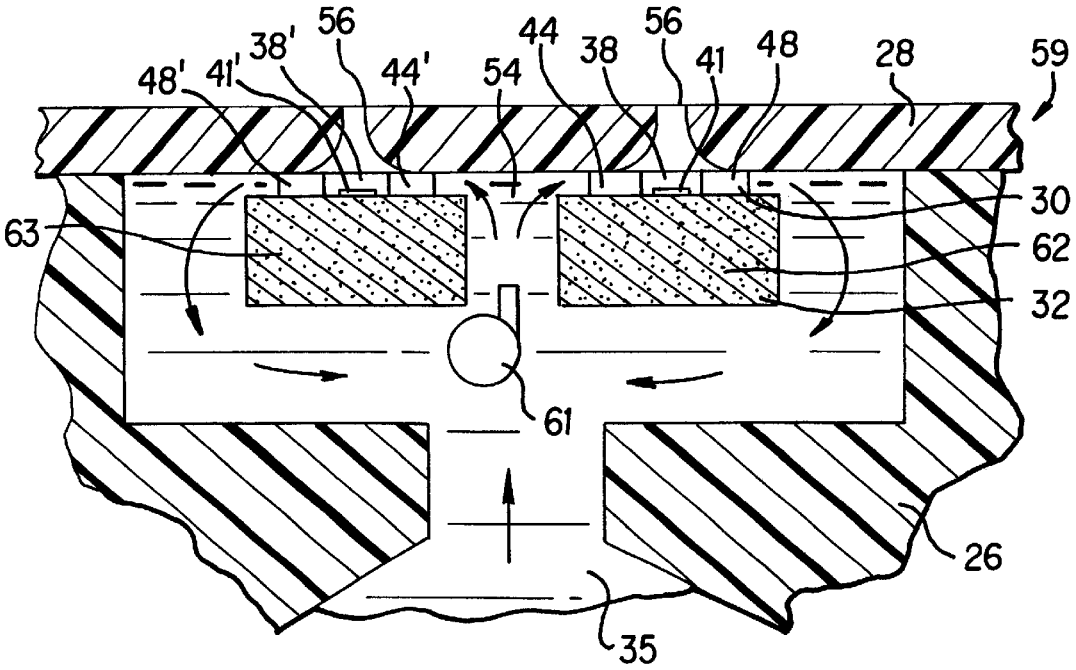
FIG. 6 is a side elevational view, in section and partially cut away, of a thermal ink-jet print head according to a second embodiment of the present invention.

The flow of ink across the silicon substrate and through the chambers can be in either direction. Referring to FIG. 6, reference numeral 59 generally indicates a print head with circulating ink flow that is opposite in direction to the ink flow illustrated in FIG. 4. In particular, a single pump 61 is directed upward into the feed slot 54 so that the flow of ink around the portion 62 of the substrate 32 is clockwise as illustrated in FIG. 6 and counter-clockwise around the portion 63 of the substrate. The positions of the inlet flow channels 44 and the outlet flow channels 48 on the substrate are, of course, reversed from those illustrated in FIG. 4 due to the reversed direction of flow. In all other respects, the construction and operation of the print head 59 is the same as described and illustrated in connection with the print head 24, FIG. 4. In like manner the single pump 61 can be any of the types described above.

In general, the inlet flow channels 44, FIGS. 4 and 6, and the outlet flow channels 48, FIGS. 4 and 6, have approximately the same hydraulic resistance R1 and R2, respectively. This feature allows the ink to flow in either direction through the firing chambers 38, i.e., there is no preferred direction of flow across the firing resistors 41.

Further, the hydraulic resistance in the entire system must be sufficiently low so that the pump(s) and the resulting pressure in the firing chambers 38 do not force ink out of the orifices 56 by overcoming the surface tension of the meniscuses 18.

It should be appreciated that although the flow channels are illustrated and described above as being in-line, i.e., co-axial, they can be axially displaced with respect to each other as long as they have approximately the same hydraulic resistance. In like manner the number of inlet and outlet flow channels can be increased as long as each combination has approximately the same hydraulic resistance.

Figure 7:
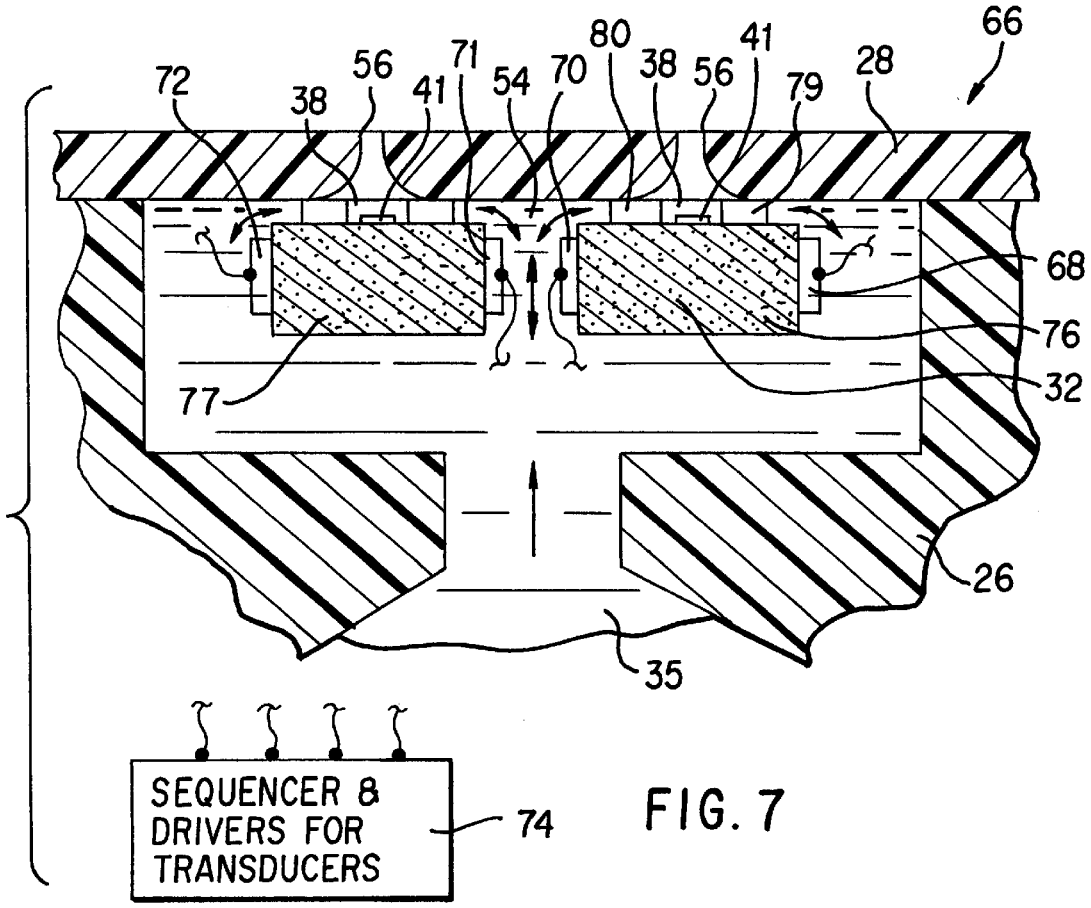
FIG. 7 is a side elevational view, in section and partially cut away, of a thermal ink-jet print head according to a third embodiment of the present invention.

The ink can be flowed across the firing resistors and through the firing chambers in various modes of flow. Referring to FIG. 7, reference numeral 66 generally indicates a print head in which the ink flow is controlled by piezoelectric transducers, in particular transducers 68, 70, 71, and 72. These transducers are of conventional construction and act in addition to any transducers that expel the drops of ink from the chambers such as the transducers in a conventional piezoelectric driven, non-thermal, ink-jet printer. The transducers 68, 70, 71, and 72 are electrically connected to a sequencer and driver circuit 74 of conventional construction. The transducers 68, 70 on the portion 76 of the silicon substrate 32 are driven in co-operation by the circuit 74 as are the transducers 71, 72 on the portion 77. In FIG. 7 the flow of ink passes through a first ink conduit or channel 79 and a second ink channel 80 in different modes and in different directions as described below. In all other respects the construction and operation of the print head 66 is as described above.

In operation, the print head 66, FIG. 7 flows the ink through the firing chambers 38 driven by the piezoelectric transducers 68, 70, 71, 72 which in turn are electrically actuated by the sequencer and driver circuit 74. In one mode of operation the ink flows across the firing resistors 41 continuously in steady state as described in connection with FIGS. 4 and 6. In another mode of operation the ink flows through the chambers 38 in a varying manner. As examples of such variation, the ink can flow in sinusoidal manner, either solely in one direction or back and forth, i.e., first in one direction and then in the other. In another mode of varying the flow, the ink is pulsed through the chambers in various abrupt patterns by the transducers. The ink can also flow in and out of the chambers with full, partial, or no recirculation around the portions 76, 77 of the substrate 32, i.e., clockwise and/or counter-clockwise flow. In all cases, however, the ink that is expelled from the print head is made up from the ink reservoir 35.

In all of the various operating modes in which the speed and direction of ink flow changes, the rate of change of such changes is substantially less than the speed at which the print head is being pulsed and drops of ink are being expelled. In effect, the ink within the firing chamber at the time drops are expelled is flowing at a speed such that the region of vibration is flushed out of the chamber, but the changes in the speed and direction of the ink neither affect the process of expelling the ink drops nor affect the trajectory of the drops.

Although FIG. 7 illustrates a print head 66 with four transducers, 68, 70, 71, and 72, any number can be used to produce the desired flow and similarly these transducers can be placed anywhere in the flow path of the ink.

The print head is also serviced by the flow of ink passing through the firing chamber. Particles of matter, gummy ink, and bubbles of air that have temporarily become lodged in the firing chamber are entrained in the flow and are flushed out of the chamber and onto regions of the print head where they will not affect its operation. These obstructions can also be removed by reversing the flow, pulsing the flow, and otherwise varying the flow through the chamber.

Figure 8:
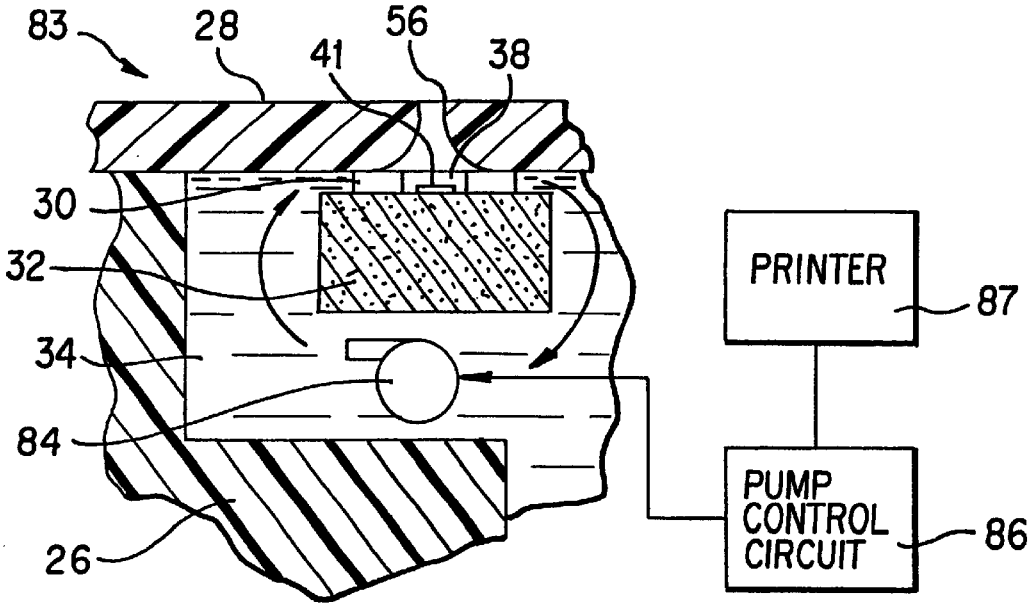
FIG. 8 is a side elevational view, in section and partially cut away, of a thermal ink-jet print head according to a fourth embodiment of the present invention.

The flow of ink through the firing chambers can also be varied in accordance with changes in the operating status of the printer within which the print head is functioning. Referring to FIG. 8, reference numeral 83 generally indicates a print head incorporating this feature. The flow of ink through the firing chamber 38 is produced by a pump 84 that varies either in speed or output or both. The operation of the pump is varied by a pump control circuit 86 of conventional construction. The pump control circuit receives signals from the printer 87 in which the print head 83 operates. These signals indicate the operating status of either the printer 87 or the print head 83 or both and include, but are not limited to, either the temperature of the print head, the rate at which drops of ink are being expelled from the print head, or the speed at which the printer is operating. In all other respects, the construction and operation of this print head is the same as the print heads illustrated in FIGS. 4, 6, and 7 and described above.

Figure 9:
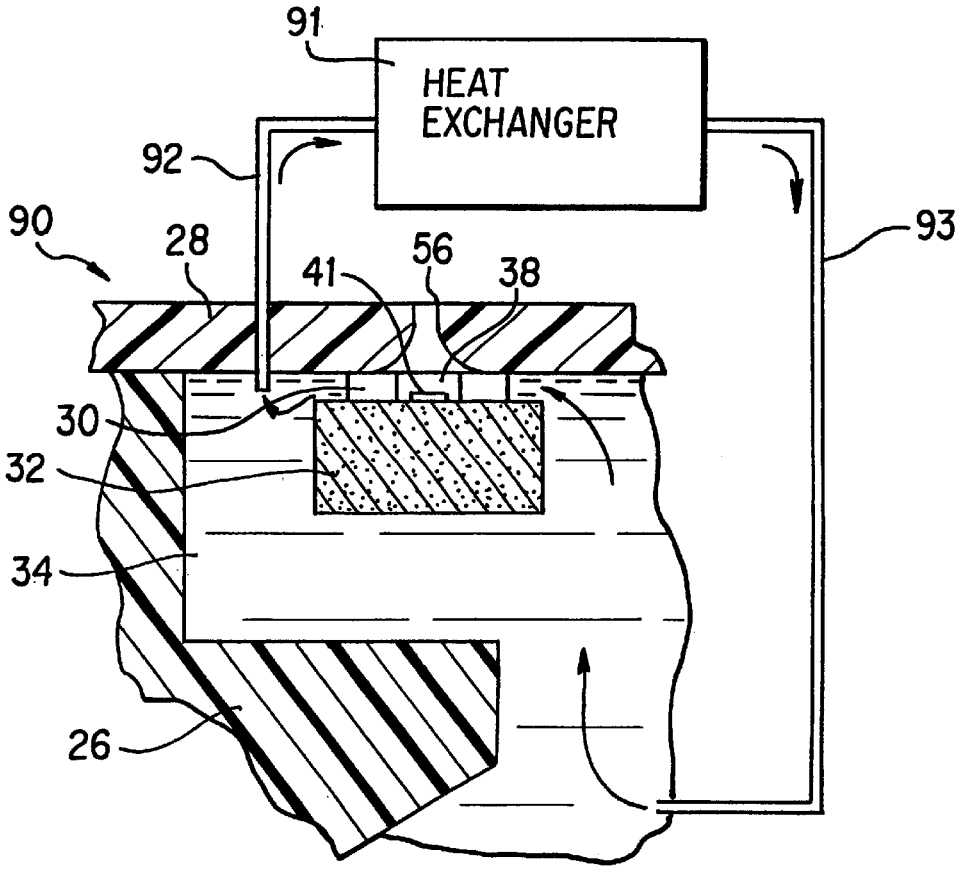
FIG. 9 is a side elevational view, in section and partially cut away, of a thermal ink-jet print head according to a fifth embodiment of the present invention.

The flow of ink through the firing chamber of a print head can be generated without the use of either electrical or mechanical energy. Referring to FIG. 9, reference numeral 90 generally indicates a print head with a flow of ink through its firing chambers 38 produced by natural circulation. Warmer ink, generally located in the upper regions of the print head, is transported in a conduit 92 to a heat exchanger 91 of conventional construction. The ink is cooled in the heat exchanger by conventional means. The cooled ink is transported back to the print head in a conduit 93 to a cooler region of the print head so that a flow of ink through the firing chambers is established and maintained by thermal convection.

Although specific embodiments of the invention have been described and illustrated, the invention is not to be limited to the specific forms or arrangement of parts so described and illustrated. The invention is limited only by the claims.

What is claimed is:

1. Apparatus for hydraulically dampening vibration developed in liquids being expelled drop by drop from a chamber, comprising:

a. an expeller for expelling liquids drop by drop in a controlled manner;

b. a chamber housing the expeller and from which the drops are expelled, the drop expeller produces vibration in the liquid that remains after drop expulsion;

c. an outlet orifice on the chamber through which the drops are expelled from the chamber;

d. an inlet conduit hydraulically connected for fluid flow into the chamber;

e. an outlet conduit hydraulically connected for fluid flow out of the chamber, said outlet conduit being hydraulically independent of the outlet orifice; and f. means, operatively connected to the chamber, both for producing liquid flow out of the inlet conduit, through the chamber, and into the outlet conduit and also for sweeping the vibration remaining in the liquid out of the chamber and into the outlet conduit so that the vibration is hydraulically damped.

2. The apparatus of claim 1 wherein the expeller is a thermal inkjet firing resistor, the chamber is an ink-jet drop firing chamber, the liquid is ink-jet ink, and the liquid flow producing means produces a continuous flow of liquid out of the inlet conduit, through the chamber, and into the outlet conduit.

3. The apparatus of claim 1 wherein the expeller is a piezoelectric transducer, the chamber is a piezoelectric drop producing chamber, the liquid is ink, and the liquid flow producing means produces a continuous flow of liquid out of the inlet conduit, through the chamber, and into the outlet conduit.

4. Apparatus for hydraulically dampening vibration developed in liquids being expelled drop by drop from a chamber, comprising:

a. an expeller for expelling liquids drop by drop in a controlled manner;

b. a chamber housing the expeller and from which the drops are expelled, the drop expeller produces vibration in the liquid that remains after drop expulsion;

c. an inlet conduit hydraulically connected for fluid flow into the chamber;

d. an outlet conduit hydraulically connected for fluid flow out of the chamber; and e. means, operatively connected to the chamber, both for producing liquid flow out of the inlet conduit, through the chamber, and into the outlet conduit and also for sweeping the vibration remaining in the liquid out of the chamber and into the outlet conduit so that the vibration is hydraulically damped, the flow producing means being a mechanical pump replenishing the chamber and recirculating the liquid through the apparatus independent of the expeller, said pump further providing variation in hydrostatic pressure within the apparatus.

5. Apparatus for hydraulically dampening vibration developed in liquids being expelled drop by drop from a chamber. comprising:

a. an expeller for expelling liquids drop by drop in a controlled manner;

b. a chamber housing the expeller and from which the drops are expelled, the drop expeller produces vibration in the liquid that remains after drop expulsion;

c. an inlet conduit hydraulically connected for fluid flow into the chamber;

d. an outlet conduit hydraulically connected for fluid flow out of the chamber; and e. means, operatively connected to the chamber, both for producing liquid flow out of the inlet conduit, through the chamber, and into the outlet conduit and also for sweeping the vibration remaining in the liquid out of the chamber and into the outlet conduit so that the vibration is hydraulically damped, the flow producing means being a transducer pulsing the liquid, independent of the expeller, through the chamber from the inlet conduit, through the chamber, and into the outlet conduit.

6. Apparatus for hydraulically dampening vibration developed in liquids being expelled drop by drop from a chamber, comprising:

a. an expeller for expelling liquids drop by drop in a controlled manner;

b. a chamber housing the expeller and from which the drops are expelled, the drop expeller produces vibration in the liquid that remains after drop expulsion;

c. an inlet conduit hydraulically connected for fluid flow into the chamber;

d. an outlet conduit hydraulically connected for fluid flow out of the chamber; and e. means, operatively connected to the chamber, both for producing liquid flow out of the inlet conduit, through the chamber, and into the outlet conduit and also for sweeping the vibration remaining in the liquid out of the chamber and into the outlet conduit so that the vibration is hydraulically damped, the flow producing means being a heat exchanger connected to the chamber providing liquid flow through the chamber by natural circulation from thermal convection.

7. Apparatus for hydraulicly dampening vibration developed in liquids being expelled drop by drop from a chamber in a printer, comprising:

a. an expeller for expelling liquids drop by drop in a controlled manner;

b. a chamber housing the expeller and from which the drops are expelled, the drop expeller produces vibration in the liquid that remains after drop expulsion;

c. a first flow conduit for the liquid, hydraulically connected to the chamber;

d. a second flow conduit for the liquid, hydraulically connected to the chamber;

e. means, operatively connected to the chamber, both for inducing liquid flow through the first and second conduits and through the chamber thereby having an output flow and also for sweeping the vibration remaining in the liquid out of the chamber so that the vibration is hydraulically damped;

f. a printer for printing images on media, said printer containing the expeller, the chamber, the first and second conduits, and the flow inducing and sweeping means, said printer also generating an output signal indicating operational status of the printer; and g. a control circuit for the flow inducing and sweeping means connected to both the flow inducing means and the printer, said circuit varies the output flow of liquid from the flow inducing and sweeping means based on the operating status signal from the printer.

8. The apparatus of claim 7 wherein the control circuit controls the output flow of liquid from the flow inducing and sweeping means according to the temperature of the expeller.

9. The apparatus of claim 7 wherein the control circuit controls the output flow of liquid from the flow inducing and sweeping means according to the amount of drops expelled from the chamber.

10. The apparatus of claim 7 wherein the control circuit controls the output flow of liquid from the flow inducing and sweeping means according to the speed at which the printer operates.

11. Method for hydraulically dampening vibration developed in liquids being expelled drop by drop from a chamber, comprising the steps of:

a. expelling a drop of liquid from a chamber;

b. creating a region of vibration in the liquid in the chamber by expelling the drop therefrom;

c. flowing a liquid from an inlet conduit having a hydraulic resistance R1, through the chamber having a hydraulic resistance R3 and into an outlet conduit having a hydraulic resistance R2. where R1 and R2 are each larger than R3; and d. sweeping the liquid region of vibration out of the chamber by the step of flowing; and e. venturi dampening the vibration by the step of flowing.

12. The method of claim 11 wherein the step of expelling a drop includes the steps of:

a. electrically pulsing a firing resistor in a thermal ink-jet print head; and b. generating thereby a drive bubble that expels the drop from the chamber.

13. The method of claim 12 wherein the step of sweeping the liquid region of vibration out of the chamber includes sweeping the dive bubble away from the firing resistor after expelling the drop from the chamber.

14. The method of claim 11 wherein the step of expelling a drop includes the steps of:

a. electrically pulsing a piezoelectric transducer; and b. expelling thereby the drop from the chamber.

15. The method of claim 11 wherein the step of flowing includes the steps of:

a. flowing the liquid continuously through the chamber at a steady velocity independently of the step of expelling;

b. recirculating the liquid continuously; and c. varying the hydrostatic pressure in the chamber with a pump.

16. The method of claim 11 wherein the step of flowing includes the step of flowing the liquid through the chamber at a varying velocity.

17. The method of claim 16 wherein the step of flowing the liquid in a varying manner includes varying the flow in a generally sinusoidal manner using means, operatively connected to the conduits and the chamber, for flowing the liquid.

18. The method of claim 16 wherein the step of flowing the liquid in a varying manner includes varying the flow by reversing the direction of flow in an alternating manner using means, operatively connected to the conduits and the chamber, for flowing the liquid.

19. The method of claim 16 wherein the step of flowing the liquid in a varying manner includes flowing the liquid through the chamber in a pulsating manner using means, operatively connected to the conduits and the chamber, for flowing the liquid.

20. The method of claim 16 wherein the step of flowing the liquid in a varying manner includes servicing the chamber using means, operatively connected to the conduits and the chamber, for flowing the liquid.

21. The method of claim 11 wherein the step of sweeping the liquid region of vibration out of the chamber includes sweeping accumulated air out of the chamber.

22. The method of claim 11 wherein the step of venturi dampening occurs at all times when flow exists out of the inlet conduit, through the firing chamber, and into the outlet conduit.

23. Method for hydraulically dampening vibration developed in liquids being expelled drop by drop from a chamber, comprising the steps of:

a. pumping liquid from an inlet channel, into a chamber, and thereafter into an outlet channel;

b. expelling a drop of liquid from the chamber through an outlet orifice, thereby creating a region of vibration of the liquid in the chamber, said outlet orifice being hydraulically independent of the outlet channel; and c. flushing the liquid region of vibration out of the chamber and into the outlet channel, thereby hydraulically dampening the vibration.

* * * * *